US006943783B1

(12) United States Patent
Ting et al.

(10) Patent No.: US 6,943,783 B1
(45) Date of Patent: Sep. 13, 2005

(54) LCD CONTROLLER WHICH SUPPORTS A NO-SCALING IMAGE WITHOUT A FRAME BUFFER

(75) Inventors: Tah-Kang Joseph Ting, Hsinchu (TW); Yin-Shing Lieu, Hsin-Chu (TW); Gyh-Bin Wang, Jung-Li (TW); Ming-Song Hwang, Hsin-Chu (TW)

(73) Assignee: Etron Technology Inc., Hsin-chu (TW)

( * ) Notice: Subject to any disclaimer, the term of this patent is extended or adjusted under 35 U.S.C. 154(b) by 597 days.

(21) Appl. No.: 10/005,807

(22) Filed: Dec. 5, 2001

(51) Int. Cl.[7] ..... G09G 5/00
(52) U.S. Cl. ..... 345/204; 212/213
(58) Field of Search ..... 345/98, 99, 103, 345/121, 131, 204, 212, 213, 501, 545, 564, 345/472; 348/445, 448, 581, 387, 845

(56) References Cited

U.S. PATENT DOCUMENTS 5,387,923 A * 2/1995 Mattison et al. ..... 345/103
5,537,128 A 7/1996 Keene et al. ..... 345/89
5,610,621 A * 3/1997 Itoh et al. ..... 345/3.1
5,699,076 A * 12/1997 Tomiyasu ..... 345/103
5,712,681 A 1/1998 Suh ..... 348/231
5,903,282 A * 5/1999 Schoner et al. ..... 345/558
5,949,438 A * 9/1999 Cyman et al. ..... 345/502
6,002,446 A * 12/1999 Eglit ..... 348/581
6,049,322 A 4/2000 Yoshikawa et al. ..... 345/103
6,072,548 A * 6/2000 Schoner et al. ..... 375/240.26
6,127,999 A * 10/2000 Mizutani ..... 345/619
6,611,260 B1 * 8/2003 Greenberg et al. ..... 345/204
2003/0117419 A1 * 6/2003 Hermanson ..... 345/660
2003/0184532 A1 * 10/2003 Chen et al. ..... 345/204

* cited by examiner

*Primary Examiner*—Amare Mengistu
(74) *Attorney, Agent, or Firm*—George O. Saile; Stephen B. Ackerman

(57) ABSTRACT

This invention provides a method and apparatus for displaying an unscaled image frame on an LCD panel. The method and apparatus uses the same line buffers available to the digital signal processor DSP formerly used for scaling the displayed image up or down in size. No extra frame buffers are required by this invention since the frame rates of the source image and the LCD panel are the same. The image frame buffer is written to the LCD panel on every other panel vertical synchronization pulse. The vertical synchronization timing is shifted to the left or right in the time domain to center the image on the LCD panel.

18 Claims, 8 Drawing Sheets

FIG. 1 – Prior Art

FIG. 2 – Prior Art

LCD CONTROLLER WHICH SUPPORTS A NO-SCALING IMAGE WITHOUT A FRAME BUFFER

BACKGROUND OF THE INVENTION

1. Field of the Invention

This invention relates to a method and apparatus for providing liquid crystal display LCD control. More particularly this invention relates to a method and apparatus for displaying unscaled images on LCD panels without a frame buffer. The method and apparatus uses the same buffers available to the digital signal processor DSP for displaying the image.

2. Description of Related Art

Today, conventional LCD controllers utilize a scaling up mapping. FIG. 1 shows a mapping of a 640 by 480 pixel image 110 being displayed on a 1024 by 768 pixel LCD display 120. The figure illustrates a scaling up of the image to fit the LCD display, which has a larger pixel format (1024 by 768) than the image (640 by 480). The mappings 130 & 140 of the starting and finishing points of the image are shown in FIG. 1. The conventional circuit to perform the above scaling up operation requires a higher clock frequency to produce a display on the LCD panel. This higher frequency is required for the scaling up digital signal processor, DSP to keep the same frame rate as the smaller image. In addition, this convention implementation needs several line buffers for temporary data storage.

FIG. 2 shows the conventional implementation of the No-scaling LCD display. In this case, a frame buffer is required to capture the whole frame of image data so that the 640 by 768 image 210 can be displayed anywhere on the LCD panel's 1024 by 768 grid 220. The mappings 230 & 240 of the starting and finishing points of the image are shown in FIG. 2. A example to illustrate the conventional method's requirement for a frame buffer. If the source image is 640×480 and the LCD panel is 1024×768, the source frame time provided without a frame buffer would be defined by 480 Hsync pulses and the LCD image frame time is given by 768 Hsync pulses. The reason why the frame buffer must be used is because the frame time for the source image has to equal that of the entire larger LCD frame. However, the available frame time for the non-scaled display image is significantly less than that of the source image as illustrated above by the difference in the number of Hsync pulses.

U.S. Pat. No. 5,537,128 (Keene, et al.) "Shared Memory for Split-Panel, LCD Display Systems" describes a memory sharing method for a split panel LCD. The method enables efficient memory sharing and video processor usage between an LCD driver and a CRT driver in a common system.

U.S. Pat. No. 5,712,681 (Suh) "Apparatus for Inputting and Outputting an Optical Image with Means for Compressing or Expanding the Electrical Video Signals of the Optical Image" shows an apparatus capable of inputting and outputting an optical image. A means of compressing or expanding the electrical video data is provided. The circuit displays the captured image on an LCD panel.

U.S. Pat. No. 6,049,322 (Yoshikawa et al) "Memory Controller for Liquid Crystal Display Panel" provides a memory controller for an LCD panel. The apparatus allows the source driver for the LCD to operate at a lower frequency than the line buffer.

BRIEF SUMMARY OF THE INVENTION

It is the objective of this invention to provide a method and an apparatus to display a source image on a LCD panel without scaling.

It is further an object of this invention to provide this LCD display using lower clock frequencies than would normally be required using the scale up display methods of the present art.

In addition, it is further the object of this invention to display on a LCD panel without the use of a frame buffer.

The objects of this invention are achieved by a method to display a source image on a LCD panel without scaling. The method begins by transferring the even image line to line buffers. This is followed by the transferring the output of these line buffers to the input of the LCD panel drivers of the upper half portion within the LCD panel. Next, the method requires the skipping of the LCD Vsync at the end of a display within the even image lines. Then, there is the transferring the odd image lines to line buffers and the transferring the output of these line buffers to the input of the LCD panel drivers of the lower half portion within the LCD panel. Finally, the method requires the blanking of the data of the odd image of this lower portion of the LCD screen.

The objects of this invention are also achieved by an apparatus to display a source image on a LCD panel without scaling. This apparatus contains a means for transferring the even image line to line buffers and a means for transferring the output of these line buffers to the input of the LCD panel drivers of the upper half portion within the LCD panel. In addition, the apparatus contains a means for skipping the LCD Vsync-pl at the end of a display within the even image lines. There is also a means for transferring the odd image lines to line buffers and for transferring the output of these line buffers to the input of the LCD panel drivers of the lower half portion within the LCD panel. Finally, the apparatus contains a means for blanking the data of said odd image of said lower portion of the LCD screen.

DETAILED DESCRIPTION OF THE INVENTION

Figure 1:
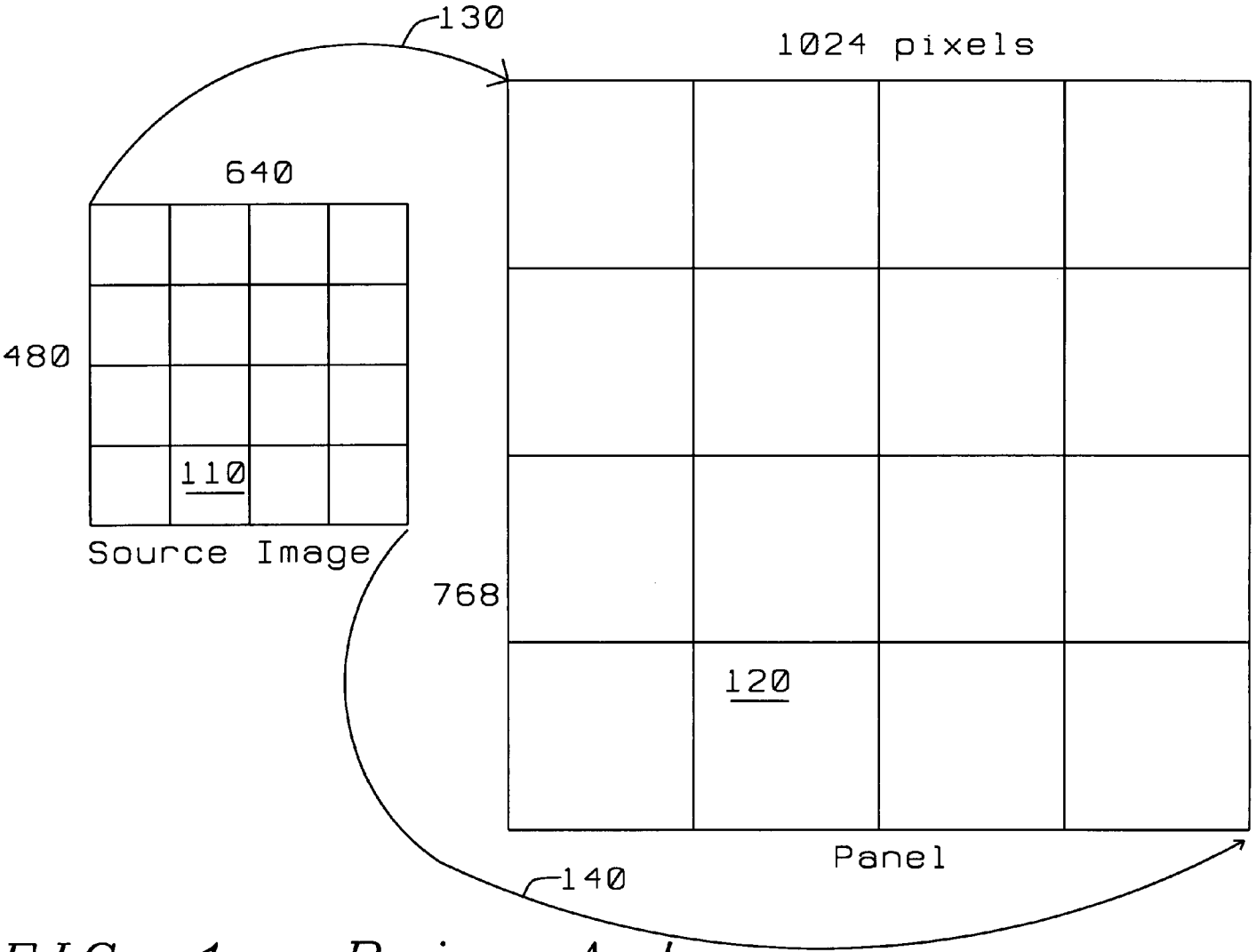
FIG. 1 shows a prior art scaling up mapping.
Figure 2:
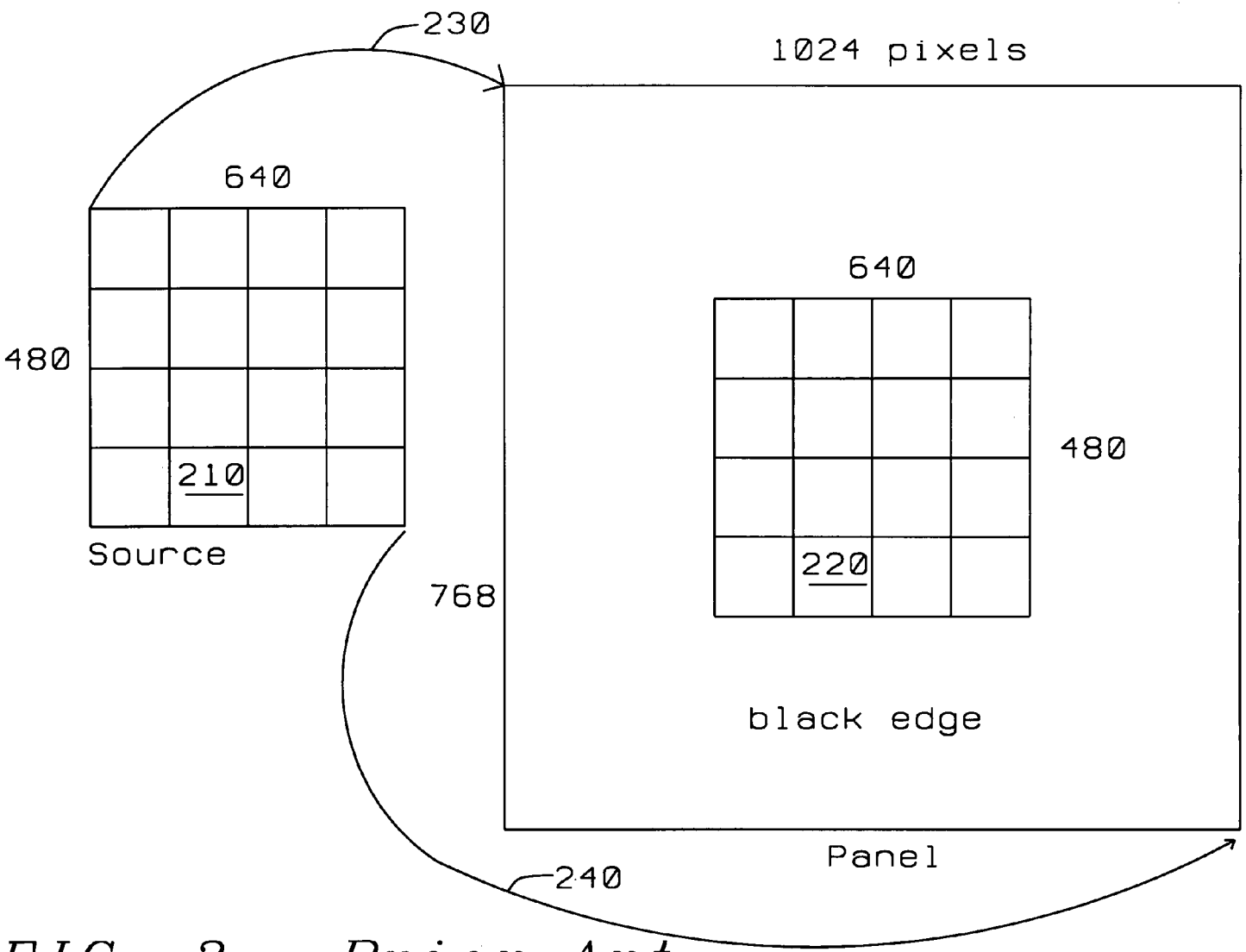
FIG. 2 shows a prior art no-scaling up mapping.
Figure 3:
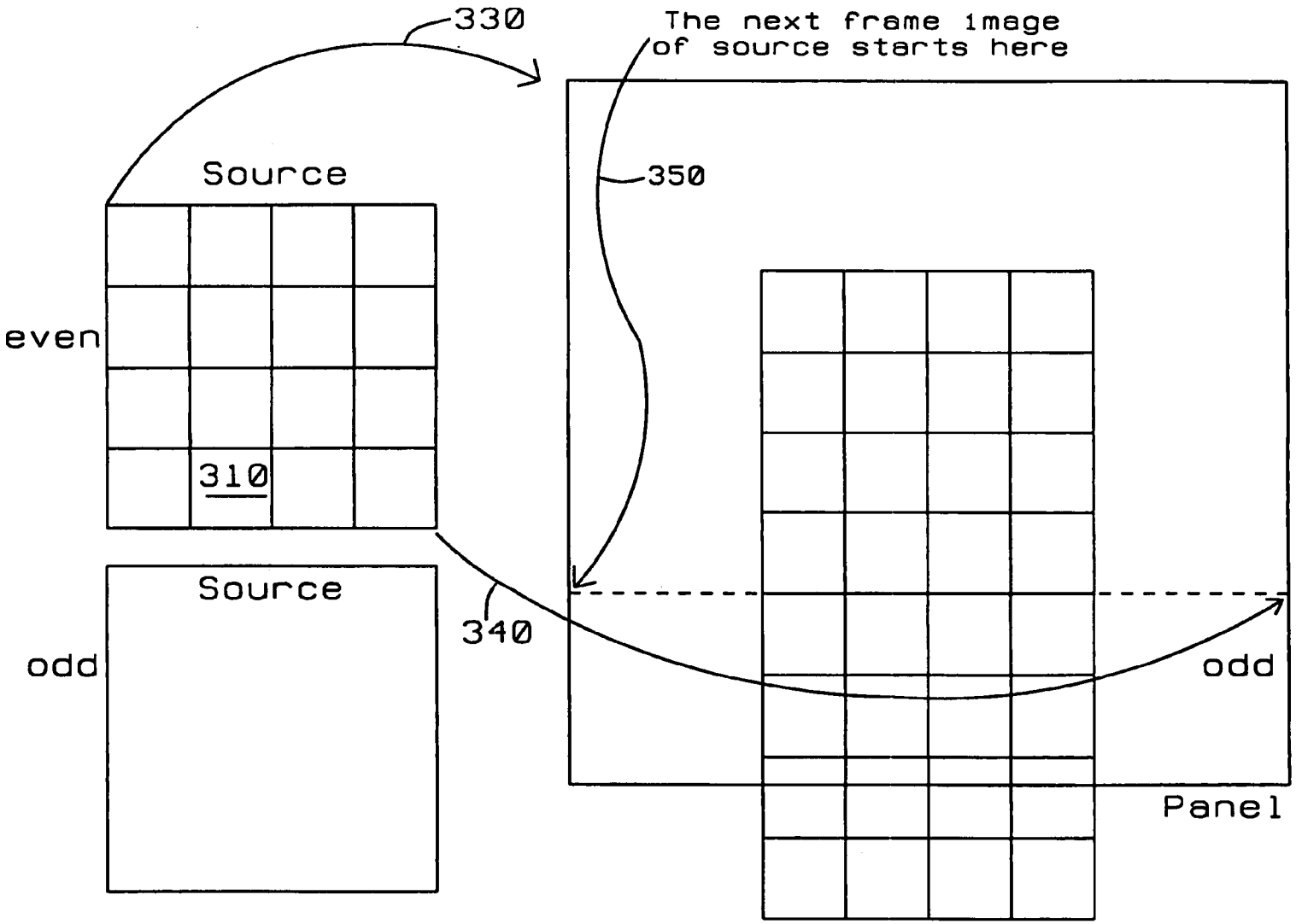
FIG. 3 shows the no-scaling up mapping algorithm of this invention Step 1.

FIG. 3 shows the first steps of the method of this invention. The even image lines 310 are mapped to the LCD panel. This figure shows the mapping of a no-scaling algorithm. The same number of line buffers are used for this mapping as is used in the traditional scaling algorithm. The digital signal processor, DSP, needs to implement and produce the non-scaling image on the LCD panel. The output of the DSP goes to the line drivers, which drive the cells of the LCD panel. The starting and finishing points of the even image lines are mapped 330, 340 to the LCD panel as shown in FIG. 3. The odd image lines are mapped 350 directly below the upper even lines.

Figure 4:
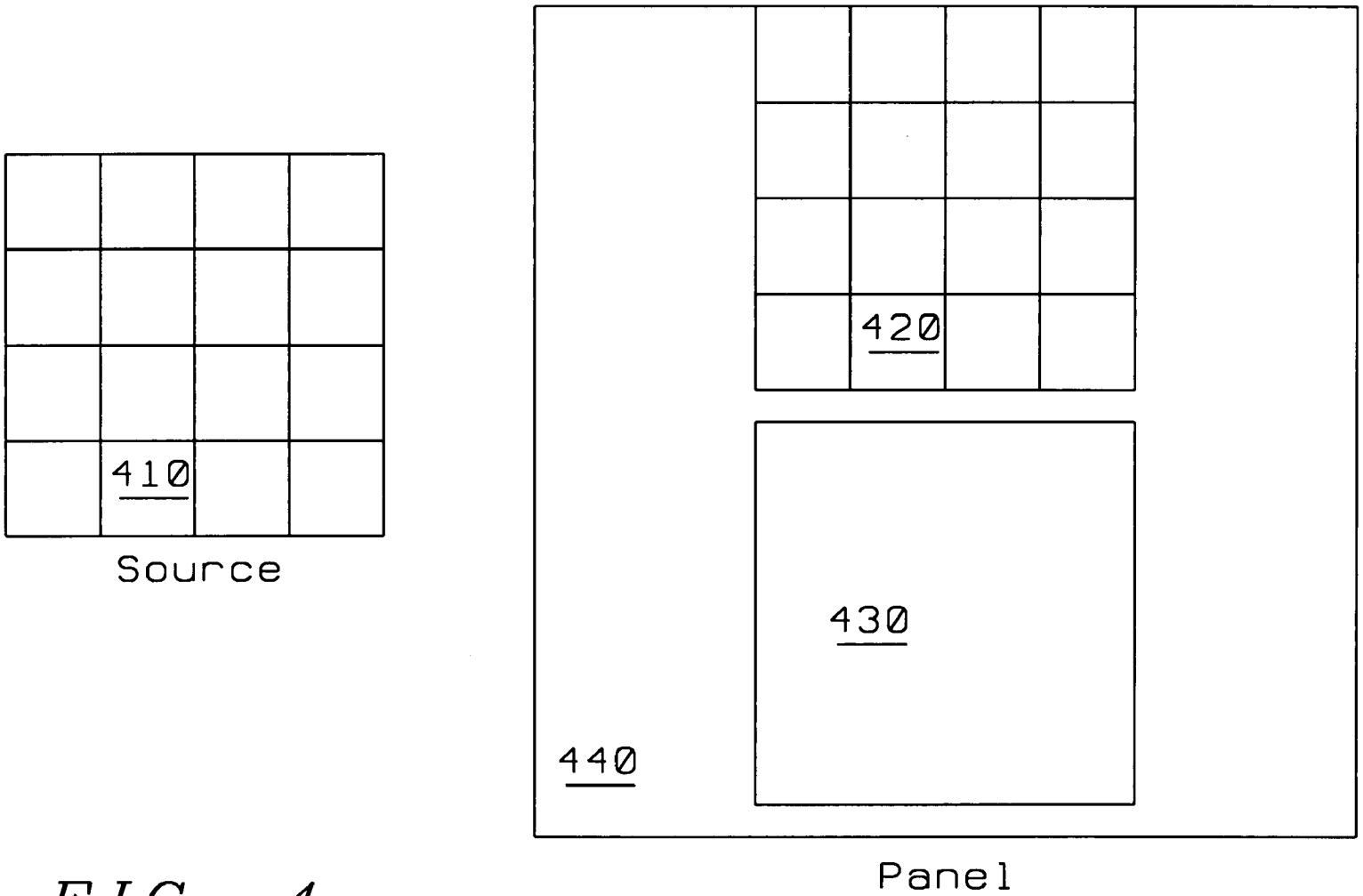
FIG. 4 shows the no-scaling up mapping algorithm of this invention Step 2.

FIG. 4 shows the next step of the method. The source 410 image and the LCD panel 440 are shown. The even image lines 420 are displayed and visible on the LCD panel. The odd image lines are blanked or not displayed 430. This method requires that one frame of data, the odd frames, is skipped every other frame. Since the odd source lines are directly adjacent to the even source lines, eliminating the odd scan lines results in minimal loss of information. While the embodiment shows a non-scaled image that occupies about half of the display panel, in general, the invention will work with various fractional sizes of the display. For example, the non-scaled image might occupy ⅔ of the display. Any source resolution smaller than the display resolution will work.

Figure 5:
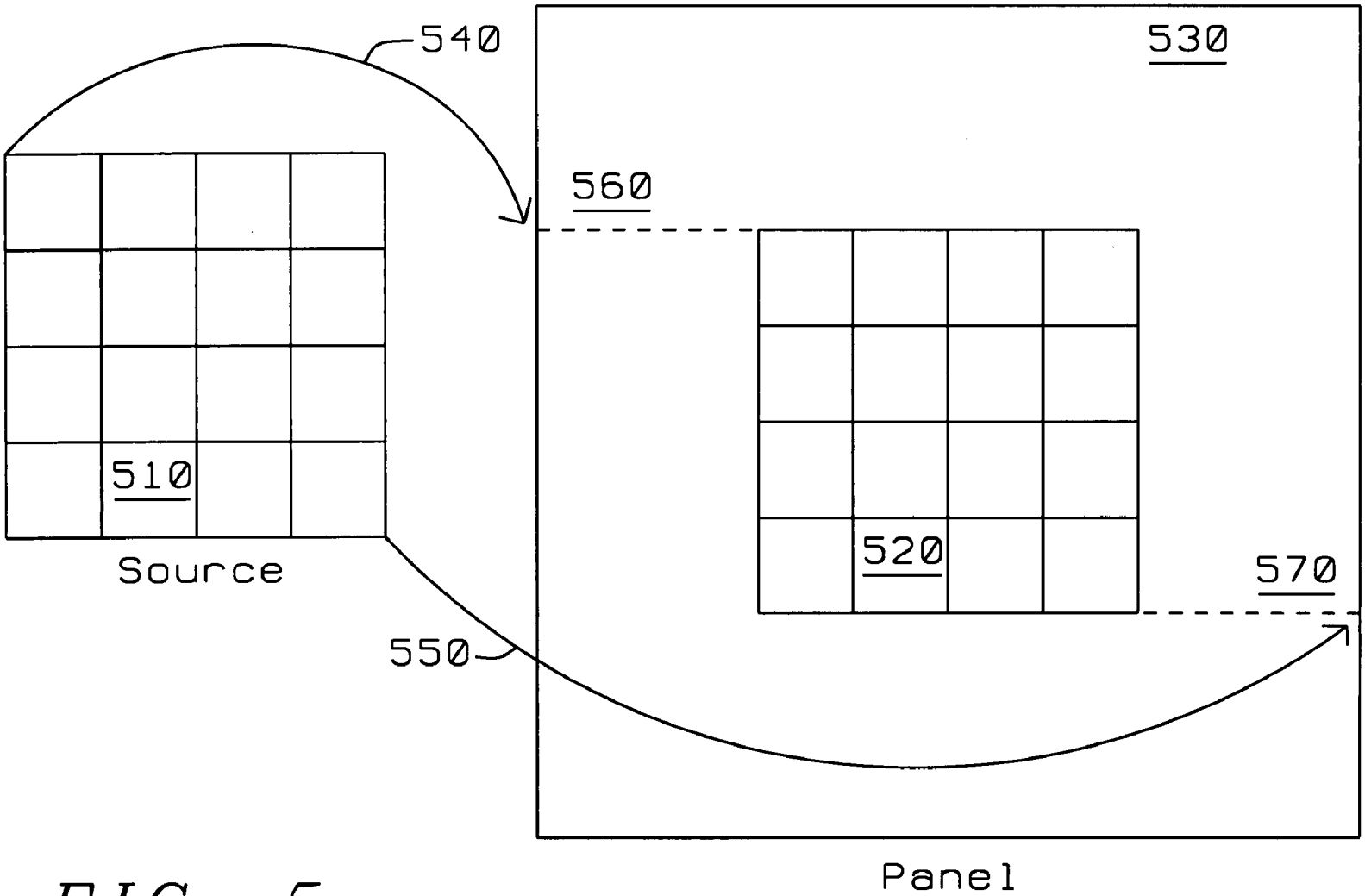
FIG. 5 shows the no-scaling up mapping algorithm of this invention (Step 3).

FIG. 5 shows the final steps of the method. The source 510 image and the LCD panel 530 are shown. The mappings 540, 550 of the starting 560 and finishing 570 points of the image to the LCD panel are shown. The non-scaled display of the image on the LCD panel is shown 520. Comparing FIGS. 4 and 5, the shift of the image display on the LCD panel is noticed. In FIG. 4, the displayable image 420 is shifted to the top of the LCD panel 440. In FIG. 5, the displayable image 520 is centered on the LCD panel 530. This shifting and centering of the image on the LCD panel is accomplished by shifting the vertical synchronization Vsync signal of the LCD panel. In this case, the Vsync signal is shifted to the left on the time domain timing diagrams.

Figure 6:
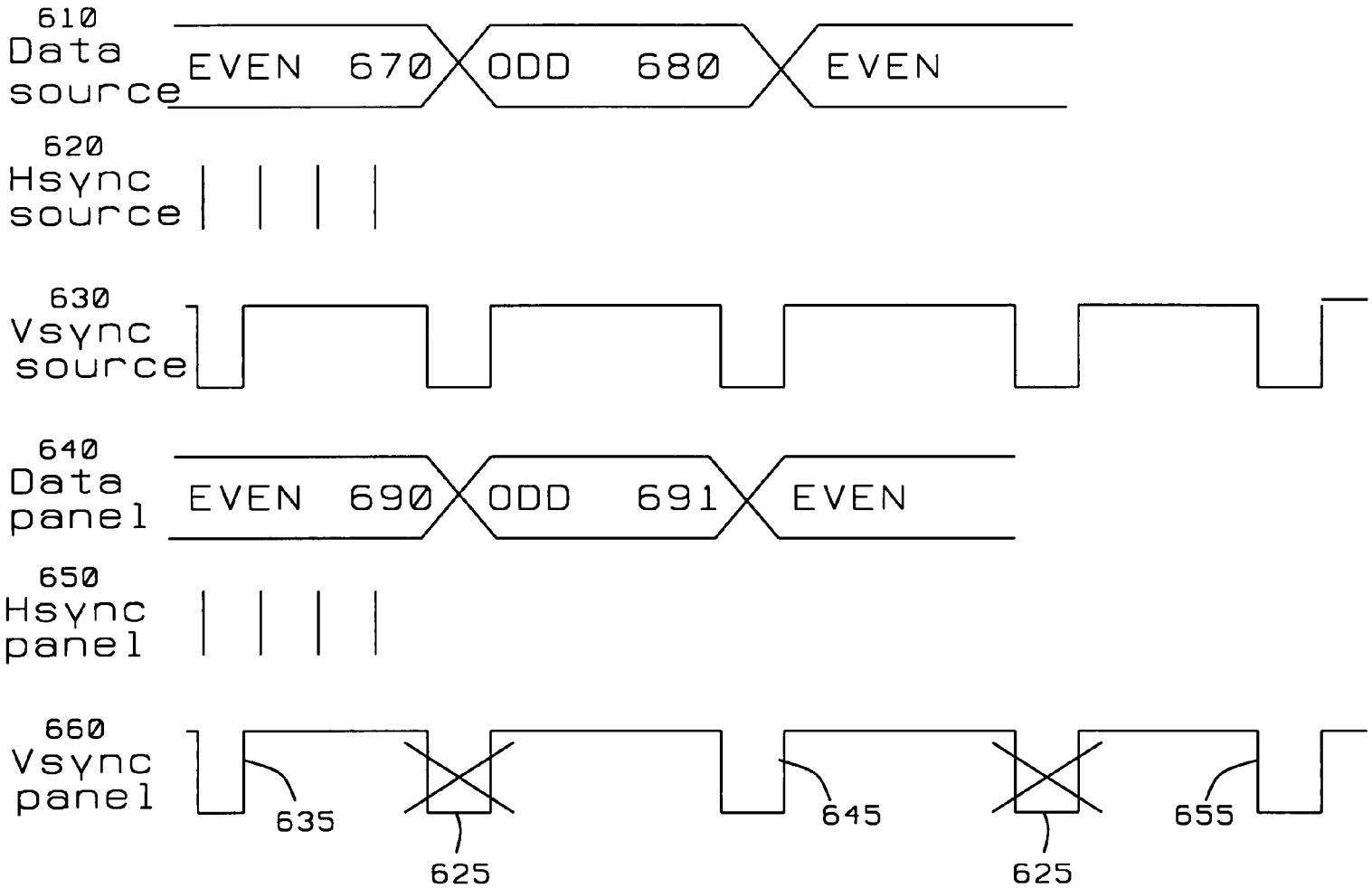
FIG. 6 shows the Vsync, Hsync Timing diagram.

FIG. 6 shows the time domain timing diagram. This diagram illustrated the source image buffer data_source 610, Hsync_source 620, and Vsync_source 630 signals. It also shows the LCD panel data panel 640, Hsync panel 650, and Vsync_panel 660 signals. The even image data 670 and the odd image data 680 are shown. However, on the LCD panel, the even data 690 is displayed while the odd data 691 is blanked out or not displayed. This is accomplished by skipping every other Vsync signal 615, 625 on the LCD panel. When a Vsync signal is skipped, the next odd frame of data is not begun at the normal starting point at the upper left of the displayable area on the LCD. Consequently, the present set of even image lines remains visable on the LCD panel.

In addition, moving the position of the even frame Vsync signals 635, 615, 655 controls the position of the image display on the LCD panel. The movement of the Vsync 635 to the left moves the image display downward. While movement of the Vsync 635 to the right moves the image display upward.

Figure 7:
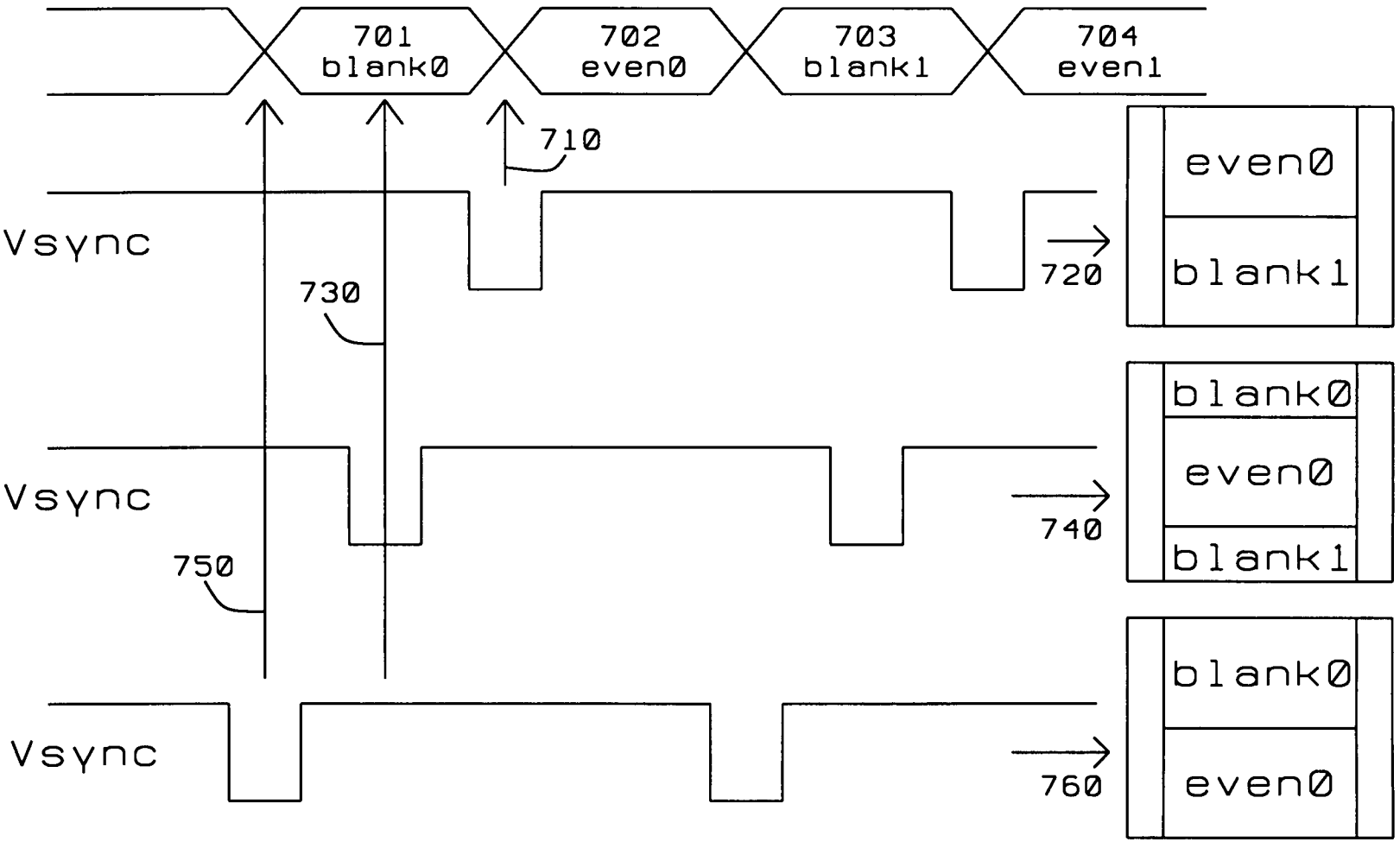
FIG. 7 shows how movement of Vsync varies the position of the image display on the LCD.

FIG. 7 further illustrates how the movement of the Vertical synchronization signal controls the position of the image display up or down on the LCD panel. FIG. 7 shows the blanked out areas 701, 703 of the display data as well as the even frames of displayable data 702, 704. There are three cases illustrated in FIG. 7. Case 1 shows the Vertical synchronization pulse lined up with the transition from blank data to Even frame displayable data 710. The corresponding LCD image display showing the displayable image starting at the top of the LCD 720. Case 2 shows the Vertical synchronization pulse occurring in the middle of the blank data 730. The corresponding LCD image display showing the displayable image centered in the middle of the LCD 740. Case 3 shows the Vertical synchronization pulse lined up with the transition from even displayable data to blank data 750. The corresponding LCD image display showing the displayable image skewed toward the bottom of the LCD 760.

FIG. 6 also illustrates that the frequency of the Vertical synchronization of the LCD panel is one half of the frequency of the Vertical synchronization of the source. Also, the frequency of the horizontal synchronization signal Hsync of the LCD panel 650 equals the Hsync of the source 620. Therefore, the Vertical synchronization frequency requirements are equal to or less than those of the source.

Figure 8:
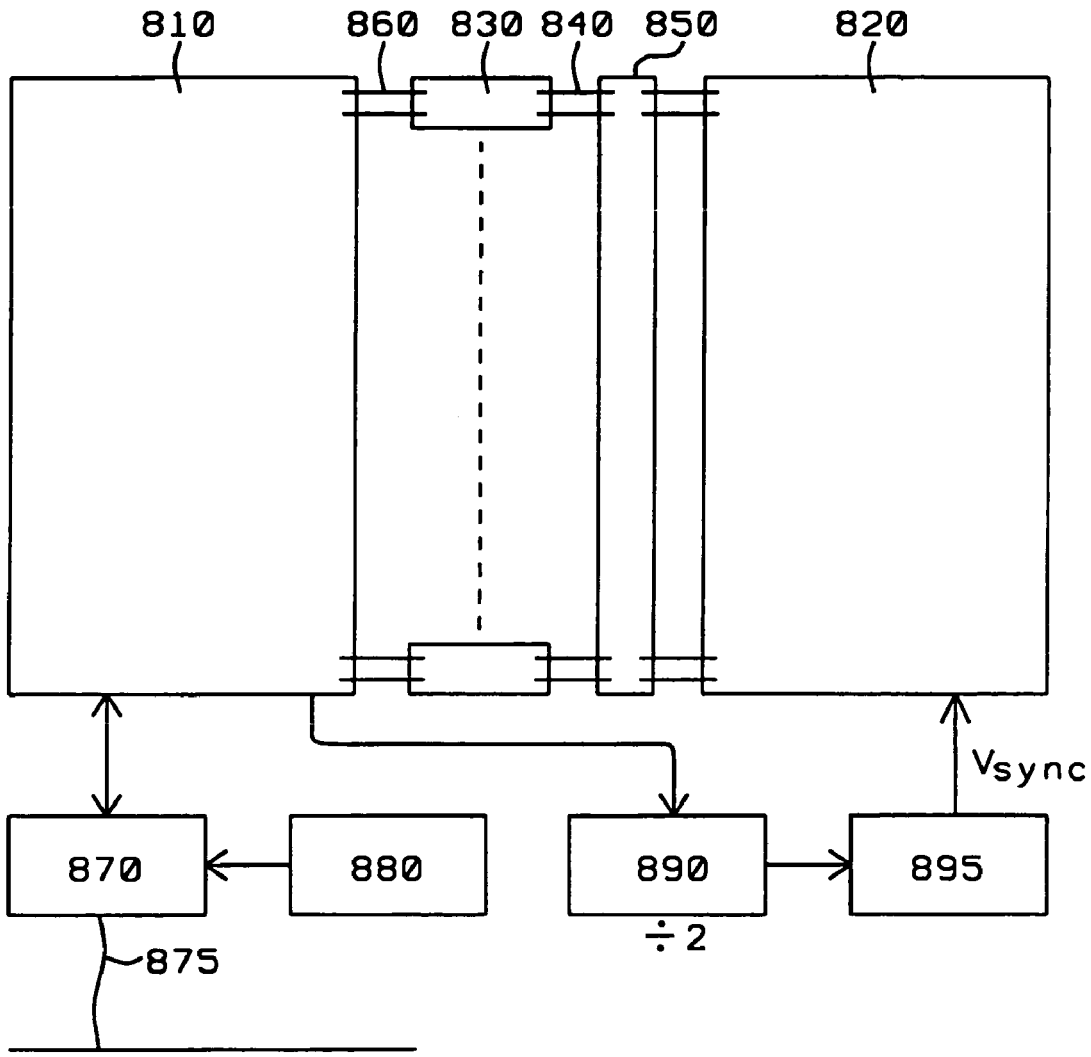
FIG. 8 shows a circuit block diagram of the main embodiment of this invention.

FIG. 8 shows a block diagram of the circuitry of the main embodiment of this invention. The image frame buffer 810 used by the digital signal processing, DSP, circuitry is shown. No additional frame buffers are required. Similarly, the line buffers 830 used by the DSP circuitry is shown. No additional line buffers are required. FIG. 8 also shows a direct connection 860 between the output of the image frame buffer 810 and the line buffer 830. It also shows a direct connection 840 between the line buffer 830 and the LCD panel driver 850 which drives the LCD panel 820. FIG. 8 also shows a program retention device 870, which is a networked 875-computer device. The program instructions are stored in a program memory 880 shown. These program instructions 880 are used to eliminate the need for a frame buffer. The computer 870 moves the no scaling image and also simulates a model of an LCD panel without scaling. FIG. 8 also shows a frequency divider 890, which is used to divide the frequency of the Vertical synchronization of the source image buffer by two. This half frequency is used to drive the LCD panel. FIG. 8 also shows logic circuitry 895, which is used to blank the display during the odd frame time domain. This is known as skipping an LCD Vertical synchronization at the end of the display within the even image lines. This logic circuitry 895 utilizes a shift register to shift the position of the Vertical synchronization in the time domain for the LCD panel.

This invention has the advantage of lower cost since extra frame buffers are not required. In addition, the circuits and apparatus required to implement the method of this invention are relatively simple. They involve halving the frequency of the Vsync signal. In addition, the circuitry is required to move the position of the Vsync signal to establish the position of the displayed image on the LCD panel.

While this invention has been particularly shown and described with Reference to the preferred embodiments thereof, it will be understood by those Skilled in the art that various changes in form and details may be made without Departing from the spirit and scope of this invention.

What is claimed is:

1. A method to display a source image on a LCD panel without scaling comprising the steps of:

transferring an even image line to line buffers, transferring the output of said line buffers to an input of LCD panel drivers of an upper half portion within the LCD panel, skipping an LCD Vertical synchronization pulse at the end of a display within said even image lines, transferring odd image lines to line buffers, transferring the output of said line buffers to the input of the LCD panel drivers of a lower half portion within the LCD panel, blanking the data of said odd image of said lower portion of the LCD screen.

2. The method of displaying a source image on an LCD panel without scaling of claim 1 further comprising the steps of:

moving a no-scaling image up or down on the LCD panel by shifting the timing of the vertical synchronization Vertical synchronization of the LCD panel to the left or right in the time domain.

3. The method of displaying a source image on an LCD panel without scaling of claim 1 further comprising the steps of:

limiting the requirement for a frame buffer.

4. A method of displaying a source image on an LCD panel without scaling and without an image buffer comprising the steps of:

skipping on vertical synchronization pulse every two normal vertical synchronization time periods, displaying the even lines of the source image, blanking the lower portion of the LCD image and, shifting the vertical synchronization pulse in order to shift the LCD image to the center of the LCD displayable area.

5. An apparatus to display a source image on a LCD panel without scaling comprising:

a means for transferring an even image line to line buffers, a means for transferring an output of said line buffers to an input of LCD panel drivers of an upper half portion within the LCD panel, a means for skipping LCD Vertical synchronization pulse at the end of a display within said even image lines, a means for transferring odd image lines to line buffers, a means for transferring an output of said line buffers to an input of LCD panel drivers of a lower half portion within the LCD panel, a means for blanking data of said odd image of said lower portion of the LCD screen.

6. The apparatus of claim 5 further comprising:

a means for moving a no-scaling image up or down on the LCD panel by shifting the timing of the Vertical synchronization of the LCD panel to the left or right in the time domain.

7. The apparatus of claim 6 where said means for moving the no-scaling image up or down on the LCD panel by shifting the timing of the Vertical synchronization of the LCD panel to the left or right in the time domain further comprising:

a means for performing said moving of Vertical synchronization for the LCD panel by utilizing a shift register to shift the Vertical synchronization the required amount to the left or right in the time domain.

8. The apparatus of claim 5 wherein there is no requirement for a frame buffer.

9. The apparatus of claim 5 wherein said means for transferring the even image lines to line buffers further comprising:

a means for performing said transfer utilizing direct connections between the output of the image buffer and the line buffers of the LCD panel.

10. The apparatus of claim 5 where said means for transferring the odd image lines to line buffers further comprising:

a means for performing said transfer utilizing direct connections between the output of the image buffer and the line buffers of the LCD panel.

11. The apparatus of claim 5 where said means for transferring the output of said line buffers to the input of the LCD panel drivers of the upper half portion within the LCD panel further comprising:

a means for performing said transfer utilizing direct connections between said line buffers and said LCD panel drivers.

12. The apparatus of claim 5 where said means for skipping the LCD Vertical synchronization pulse at the end of a display within said even image lines further comprising:

a means for performing said skipping utilizing a frequency divider to divide the image source buffer Vertical synchronization by two.

13. The apparatus of claim 5 where said means for blanking the data of said odd image of said lower portion of the LCD screen further comprising:

a means for performing said blanking utilizing a logic circuitry which senses the odd frame time domain.

14. An apparatus for displaying a source image on an LCD panel without scaling and without an image buffer comprising:

a means for skipping on vertical synchronization pulse every two normal vertical sync time periods, a means for displaying the even lines of the source image, a means for blanking the lower portion of the LCD image and, a means for shifting the vertical synchronization pulse in order to shift the LCD image to the center of the LCD displayable area.

15. A program retention device containing program instruction code executable on at least one networked computing device for simulating a model of an LCD panel without scaling, whereby said program performs the steps of:

transferring the even image line to line buffers, transferring the output of said line buffers to the input of the LCD panel drivers of the upper half portion within the LCD panel, skipping the LCD Vertical synchronization pulse at the end of a display within said even image lines, transferring the odd image lines to line buffers, transferring the output of said line buffers to the input of the LCD panel drivers of the lower half portion within the LCD panel, blanking the data of said odd image of said lower portion of the LCD screen.

16. The program retention device of claim 15, wherein said program further performs the step of:

moving the no-scaling image up or down on the LCD panel by shifting the timing of the Vertical synchronization of the LCD panel to the left or right in the time domain.

17. The program retention device of claim 15, wherein said program eliminates the requirement for a frame buffer.

18. A program retention device for displaying a source image on an LCD panel without scaling and without an image buffer, whereby said program performs the steps of:

skipping on vertical synchronization pulse every two normal vertical sync time periods, displaying the even lines of the source image, blanking the lower portion of the LCD image and, shifting the vertical synchronization pulse in order to shift the LCD image to the center of the LCD displayable area.

* * * * *

UNITED STATES PATENT AND TRADEMARK OFFICE
Certificate

Patent No. 6,943,783 B1 Patented: September 13, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Tah-Kang Joseph Ting, Hsinchu (TW); Yin-Shing Lieu, Hsin-Chu (TW); Gyh-Bin Wang, Jung-Li (TW); Ming;Song Hwang, Hsin-Chu (TW); and Huei-Te Hsu, Hsinchu (TW).

Signed and Sealed this Third Day of July 2007.

SUMATI LEFKOWITZ
*Supervisory Patent Examiner*
Art Unit 2629